US005285184A

United States Patent [19]

Hatta et al.

[11] Patent Number: 5,285,184

[45] Date of Patent: Feb. 8, 1994

[54] CHIP-TYPE NETWORK RESISTOR

[76] Inventors: Hisao Hatta, 131-19 Kitada, Wakuya-cho, Touda-gun, Miyagi-ken; Kunio Kurihara, 6-7-1 Minaminaruse, Machida-shi, Tokyo-to; Saburo Inagaki, 1-5-1-1008 Utsukushigaoka, Midori-ku, Yokohama-shi, Kanagawa-ken, all of Japan

[21] Appl. No.: 718,131

[22] Filed: Jun. 20, 1991

[30] Foreign Application Priority Data

Jul. 3, 1990 [JP] Japan ..... 2-70354[U]

[51] Int. Cl.[5] ..... H01C 1/012; H01C 3/12; H01C 1/14

[52] U.S. Cl. ..... 338/313; 338/293; 338/325; 338/327

[58] Field of Search ..... 338/313, 325, 326, 327, 338/22 R, 293

[56] References Cited

U.S. PATENT DOCUMENTS 3,745,508 7/1973 Bruder et al. ..... 338/320
3,964,087 6/1976 Mallon ..... 338/306

*Primary Examiner*—Marvin M. Lateef
*Attorney, Agent, or Firm*—Thomas R. Morrison

[57] ABSTRACT

Disclosed herein is a chip-type network resistor characterized in that resistance layers are formed between a common electrode extending across an insulative substrate and each of a plurality of separate electrodes disposed in the opposite sides of the insulative substrate used to support the common electrode, and overcoat layers are provided to cover the resistance layers and positioned to expose the common electrode, whereby the plating process is applied to the common electrode and the separate electrodes.

3 Claims, 1 Drawing Sheet

PRIOR ART

CHIP-TYPE NETWORK RESISTOR

BACKGROUND OF THE INVENTION

1. Field of the Invention

The present invention relates to a chip-type network resistor suitable for high density wiring.

2. Description of the Related Art

There has recently been used a chip-type network resistor shown in FIG. 3 as an alternative to individual chip resistors mounted side by side for wiring.

In the same drawing, separate electrodes 2 are formed on the opposite sides of an insulative substrate 1 made of ceramic by printing four areas of silver paste (or silver/-palladium paste) on one of both sides of the insulative substrate 1, i.e., eight areas in total on both sides thereof. Each of resistance layers 3 is formed by printing on a position for connecting between the separate electrodes 2, 2 set in pair on the insulative substrate 1. Then, these resistance layers 3 are subjected to primary coating with glass material or the like, and thereafter trimming grooves (not shown) are defined in the resistance layers 3 by a means such as laser trimming, thereby adjusting the resistance values of the resistance layers 3. After a trimming process has been made, the so-adjusted resistance layers 3 are covered with an overcoat layer 4, as secondary coating, comprised of glass material or the like. After the overcoat layer 4 has been formed thereon, a nickel plating process for preventing silver from being excessively consumed and a solder plating process for ensuring wettability by solder are successively applied to the respective separate electrodes 2. However, since the plating material does not adhere to each of the resistance layers 3 which have been covered with the overcoat layer 4 at the time of such a plating step, there is no possibility of variations in preset resistance values, and moisture-proof characteristics are kept satisfactory.

If such a chip-type network resistor is used, a plurality of chip-type resistors is equivalently mounted as a single unit by simply mounting one chip-type network resistor, thereby greatly improving the workability. When the intervals defined between the adjacent resistance layers 3 on the insulative substrate 1 are reduced, the chip-type network resistor can be mounted even on a high-density type printed-wiring board in which the pitch between adjacent patterns is narrow.

In recent years, there have widely been used, as printed-wiring boards, those subjected to high density increasingly and in which the pitch between adjacent patterns is set to be narrowest. Thus, the chip-type network resistor of the above-described type is not suitable in many cases. In order to permit higher-density wiring or mounting, there has been proposed, as shown in FIG. 4, a chip-type network resistor of a type in which a plurality of resistance layers 3 each mounted between a common electrode 5 extending across an insulative substrate 1 and each of separate electrodes 2 are disposed on both sides of the common electrode 5 in a zigzag manner, and the thus-disposed resistance layers 3 are covered with an overcoat layer 4. However, this type of chip-type network resistor has the problem that the impedance of the common electrode 5 is slightly large and is susceptible to the influence of noise.

OBJECTS AND SUMMARY OF THE INVENTION

With the foregoing problem in view, it is an object of the present invention to provide a chip-type network resistor which permits high-density mounting and is insusceptible to the influence of noise.

It is another object of the present invention to provide a chip-type network resistor comprising a common electrode extending on an insulative substrate along the longitudinal direction thereof, a plurality of separate electrodes disposed in the opposite sides of the insulative substrate serving to hold the common electrode thereon, a plurality of resistance layers provided between the common electrode and each of the plurality of separate electrodes, and overcoat layers each disposed to cover the plurality of resistance layers and positioned in a location where the common electrode is exposed, whereby a plating process is applied to the common electrode and the plurality of separate electrodes.

It is a further object of the present invention to provide a chip-type network resistor comprising a common electrode extending on an insulative substrate along the longitudinal direction thereof, a plurality of separate electrodes formed into a zigzag manner relative to each other at the opposite sides of the insulative substrate serving to hold the common electrode thereon, a plurality of resistance layers provided between the common electrode and each of the plurality of separate electrodes, and overcoat layers each disposed to cover the plurality of resistance layers and positioned in a location where the common electrode is exposed, whereby a plating process is applied to the common electrode and the plurality of separate electrodes.

The present inventors have discovered that the plating process cannot be applied when the common electrode is covered with the overcoat layers, thus increasing the impedance of the common electrode. In other words, the plating process can be applied to the common electrode according to the present invention, thereby making it possible to reduce the impedance of the common electrode.

According to the present invention, as described above, the plurality of resistance layers are disposed in the opposite sides of the common electrode extending across the insulative substrate. Therefore, the present invention can be applied even when the pitch between the adjacent patterns is narrowest. In addition, the overcoat layers are provided to cover the resistance layers and positioned to expose the common electrode. Thus, the plating process can be applied to the common electrode, thereby making it possible to reduce the impedance thereof. It is therefore possible to provide a superb chip-type network resistor which is suitable for use in the high-density mounting and insusceptible to the influence of noise.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

One embodiment of the present invention will hereinafter be described with reference to FIGS. 1 and 2.

Figure 1:
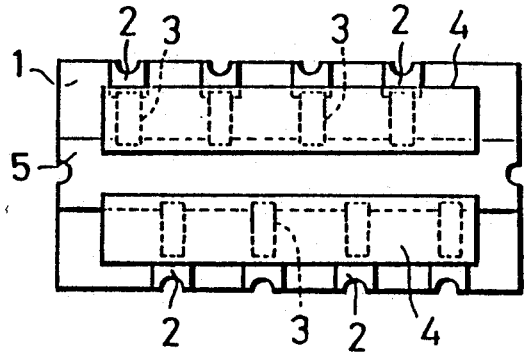
FIG. 1 is a plan view of a chip-type network resistor according to one embodiment of the present invention.
Figure 3:
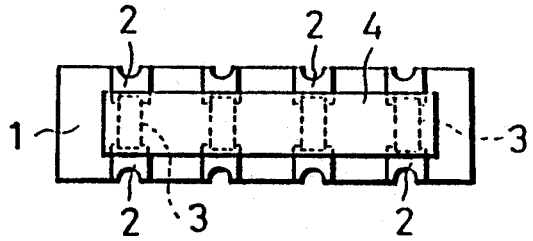
Fig.3 PRIOR ART
FIG. 3 is a plan view of a conventional chip-type network resistor.
Figure 4:
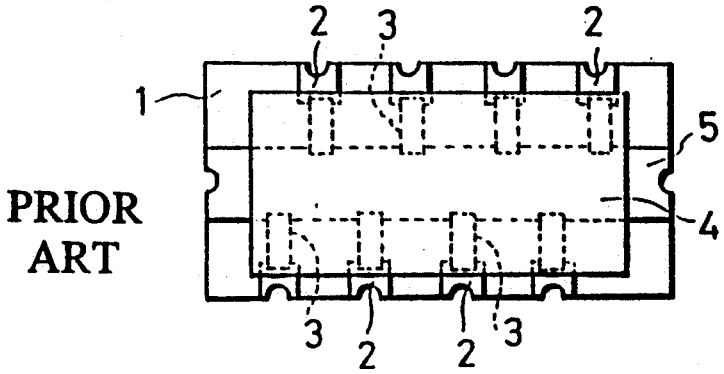
FIG. 4 is a plan view of a chip-type network resistor which is proposed to meet a demand for high density wiring.

FIG. 1 is a plan view of a chip-type network resistor according to the present embodiment. FIG. 2 is a perspective view of the chip-type network resistor. Those parts shown in FIGS. 1 and 2 which correspond to those shown in FIGS. 3 and 4 are identified by like reference numerals.

Figure 2:
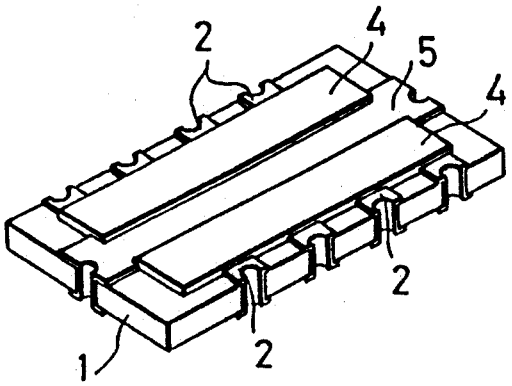
FIG. 2 is a perspective view of the chip-type network resistor of FIG. 1.

Referring to FIGS. 1 and 2, there are formed a common electrode 5 and a plurality of separate electrodes 2 by printing silver paste (or silver/palladium paste). The common electrode 5 extends in the direction of length of an insulative substrate 1 made of ceramic across the upper surface thereof, and the plurality of separate electrodes 2 are disposed in the opposite sides of the insulative substrate 1 with the common electrode 5 held thereon. A plurality of resistance layers 3 disposed between the common electrode 5 and the separate electrodes 2 are subjected to primary coating with glass material or the like, and thereafter trimming grooves (not shown) are defined by making use of a method such as laser trimming, etc. so as to adjust the resistance values of the resistance layers 3. After a trimming process has been performed, overcoat layers 4 comprised of glass material or the like are printed as secondary coating on the both sides of the common electrode 5 so as to cover the respective resistance layers 3. A nickel plating process and a solder plating process are successively applied to the common electrode 5 and the respective separate electrodes 2 which are not covered by the overcoat layers 4.

More specifically, such a chip-type network resistor can keep preset resistance values stable because plating material does not adhere to the resistance layers 3 which have been covered by the overcoat layers 4. In addition, silver is prevented from being excessively consumed by subjecting the common electrode 5 and the separate electrodes 2 to the plating process, and the wettability by solder is secured.

In the above-described embodiment, the plurality of resistance layers 3 and the separate electrodes 2 are disposed in a zigzag manner in the opposite sides of the common electrode 5. Therefore, the chip-type network resistor can effectively be used as a plurality of resistor suitable for the high density wiring or mounting even when the pitch between adjacent patterns of a printed-wiring board is quite narrow.

Further, the plating process is applied even to the common electrode 5 in the above-described embodiment. Therefore, the impedance of the common electrode 5 can be reduced and hence the chip-type network resistor serves as a resistor insusceptible to the influence of noise thereon.

Having now fully described the invention, it will be apparent to those skilled in the art that many changes and modifications can be made without departing from the spirit or scope of the invention as set forth herein.

What is claimed is:

1. A chip-type network resistor comprising:

an insulative substrate;

a common electrode disposed on said insulative substrate;

a plurality of separate electrodes disposed on said insulative substrate adjacent said common electrode;

a plurality of resistance layers, each of said plurality of resistance layers being disposed to electrically connect said common electrode and one of said plurality of separate electrodes;

an overcoat layer disposed to cover said plurality of resistance layers and a first portion of said common electrode;

a second portion of said common electrode remaining uncovered by said overcoat layer, whereby said second portion remains exposed for subsequent processes;

a conductive plating layer disposed to cover at least said second portion of said common electrode; and said conductive plating layer reducing an impedance of said common electrode, whereby a noise in said network resistor is reduced.

2. A chip-type network resistor of claim 1 wherein:

said insulative substrate has a plurality of sides;

said common electrode is disposed to connect first oppose ones of said plurality of sides;

said plurality of separate electrodes further comprising first and second groups being disposed along second opposing ones of said plurality of sides;

said resistance layers including a third group of resistance electrodes connecting said common electrode with said first group of separate electrodes and a fourth group of resistance electrodes connecting said common electrode with said second group of separate electrodes; and said overcoat layer further comprises said first portion covering said third group of resistance electrodes and said second portion covering said fourth group of resistance electrodes such that said first and second portions are separated by said common electrode.

3. A method of forming a chip-type network resistor comprising the steps of:

forming a common electrode and a plurality of separate electrodes on an insulative substrate;

forming a plurality of resistance layers provided between said common electrode and each of said plurality of separate electrodes;

forming overcoat layers each disposed to cover said resistance layers and a first portion of said common electrode;

the step of forming overcoat layers including leaving a second portion of said common electrode uncovered, whereby said second portion remains exposed for subsequent processes;

applying conductive plating material to at least said second portion of said common electrode; and said conductive plating material reducing an impedance of said common electrode, whereby a noise in said network resistor is reduced.

* * * * *

UNITED STATES PATENT AND TRADEMARK OFFICE

CERTIFICATE OF CORRECTION

PATENT NO. : 5,285,184

DATED : February 8, 1994

INVENTOR(S) : Hisao HATTA, Kunio KURIHARA, and Saburo INAGAKI

It is certified that error appears in the above-identified patent and that said Letters Patent is hereby corrected as shown below:

On title page, add the following:

[73] Assignee: KOA Kabushiki Kaisha,
Nagaro, Japan.

Signed and Sealed this

Second Day of January, 1996

*Attest:*

*Attesting Officer*

BRUCE LEHMAN

*Commissioner of Patents and Trademarks*